United States Patent [19]

Hunter

[11] Patent Number: 4,624,412

[45] Date of Patent: Nov. 25, 1986

[54] REVERSIBLE TURBINE DRIVEN SPRINKLER UNIT

[76] Inventor: Edwin J. Hunter, 5551 Codorniz Rd., Rancho Santa Fe, Calif. 92067

[21] Appl. No.: 648,949

[22] Filed: Sep. 10, 1984

[51] Int. Cl.[4] ..... B05B 3/04; B05B 15/10; B05B 1/26

[52] U.S. Cl. ..... 239/232; 239/205; 239/206; 239/240; 239/504; 239/512; 239/DIG. 1

[58] Field of Search ..... 239/222.13, 231, 232, 239/203–206, 504, 505, 509–513, 237, 240, 242, DIG. 1

[56] References Cited

U.S. PATENT DOCUMENTS

| | | | |
|---|---|---|---|
| 1,864,892 | 6/1932 | Coles et al. | 239/242 X |
| 3,523,647 | 8/1970 | Radecki | 239/206 |
| 3,782,638 | 1/1974 | Bumpstead | 239/242 |
| 3,888,417 | 6/1975 | Harmon | 239/231 X |
| 4,091,997 | 5/1978 | Ridgway | 239/206 |
| 4,198,000 | 4/1980 | Hunter | 239/206 X |
| 4,201,344 | 5/1980 | Lichte | 239/206 X |
| 4,253,608 | 3/1981 | Hunter | 239/206 |
| 4,417,691 | 11/1983 | Lockwood | 239/DIG. 1 X |

*Primary Examiner*—Joseph F. Peters, Jr.
*Assistant Examiner*—Mary Beth O. Jones
*Attorney, Agent, or Firm*—Baker, Maxham & Jester

[57] ABSTRACT

A reversible turbine driven sprinkler unit includes a sprinkler head incorporating a nozzle that is continuously driven by a reversible turbine which continuously oscillates the head between selectable reversing stops for covering a selected part of a circle. A water turbine which is driven by the water supply to the nozzle includes a reversible stator for alternating the direction of rotation of the turbine which is drivingly connected through a gear train to the sprinkler head. A reversing mechanism includes a shifting shaft extending axially from the turbine stator through the turbine, the drive train and the sprinkler head terminating in a cylindrical cavity formed in the top of the sprinkler head in which it is positioned, in an adjustable position, reversing stops for alternately engaging a reversing arm mounted on the shifting shaft for shifting the stator of the turbine to its selected alternate positions. A flow interrupter is intermittently driven in one direction by the oscillation of the sprinkler head to change its position in front of the nozzle for intermittently interrupting the flow of water from the nozzle.

17 Claims, 11 Drawing Figures

REVERSIBLE TURBINE DRIVEN SPRINKLER UNIT

BACKGROUND OF THE INVENTION

The present invention relates generally to high volume sprinkler heads and pertains particularly to reversible turbine driven sprinkler unit designed to cover selected parts of a circle.

Automatic sprinkler units having an oscillating sprinkler head which is adjustable for covering a selected part of a circle are known in the art. In my prior U.S. Pat. No. 4,253,608 granted Mar. 3, 1982, I disclosed a part circle sprinkler with a reversible stator that incorporated an improved speed control device and an improved reversing mechanism. The switching arm for the control mechanism of that prior invention however extended through the side walls of the housing to the exterior thereof. This provided exterior adjustability of the circle limits of the coverage of the sprinkler head. The present invention provides an improved reversing mechanism for sprinkler units of that type.

High volume sprinkler units designed to cover large areas must have a large generally uninterrupted stream of water to obtain the maximum range. This however is inconsistent with the optimum water coverage in that the stream tends to concentrate the water at the outer diameter of its coverage. Such sprinkler units do not typically provide a uniform coverage throughout the arc or circle pattern of its coverage. One approach to improving the coverage is the use of the oscillating spoon which oscillates into the stream from the nozzle as the sprinkler head rotates.

The present invention provides an improved device for achieving optimum water coverage throughout the range of the sprinkler unit.

SUMMARY AND OBJECT OF THE INVENTION

It is the primary object of the present invention to provide an improved turbine driven sprinkler unit.

In accordance with the primary aspect of the present invention, a reversing turbine sprinkler unit is provided with a reversing linkage that extends coaxially of the sprinkler unit to a position centrally of the sprinkler head for ease of access and adjustment of the limits of coverage.

Another aspect of the present invention includes a constantly changing stream interrupter for periodically interrupting the stream of water to improve the coverage.

BRIEF DESCRIPTION OF THE DRAWINGS

The above and other objects and advantages of the present invention will be apparent from the following description when read in conjunction with the drawings wherein.

DETAILED DESCRIPTION OF THE PREFERRED EMBODIMENT

Figure 1:
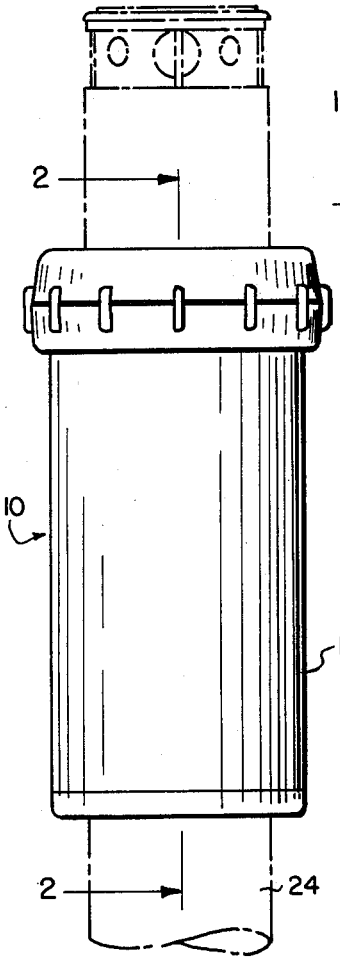
FIG. 1 is a side elevation view of a sprinkler unit in accordance with the preferred embodiment of the invention showing an extended position for the sprinkler head.
Figure 2:
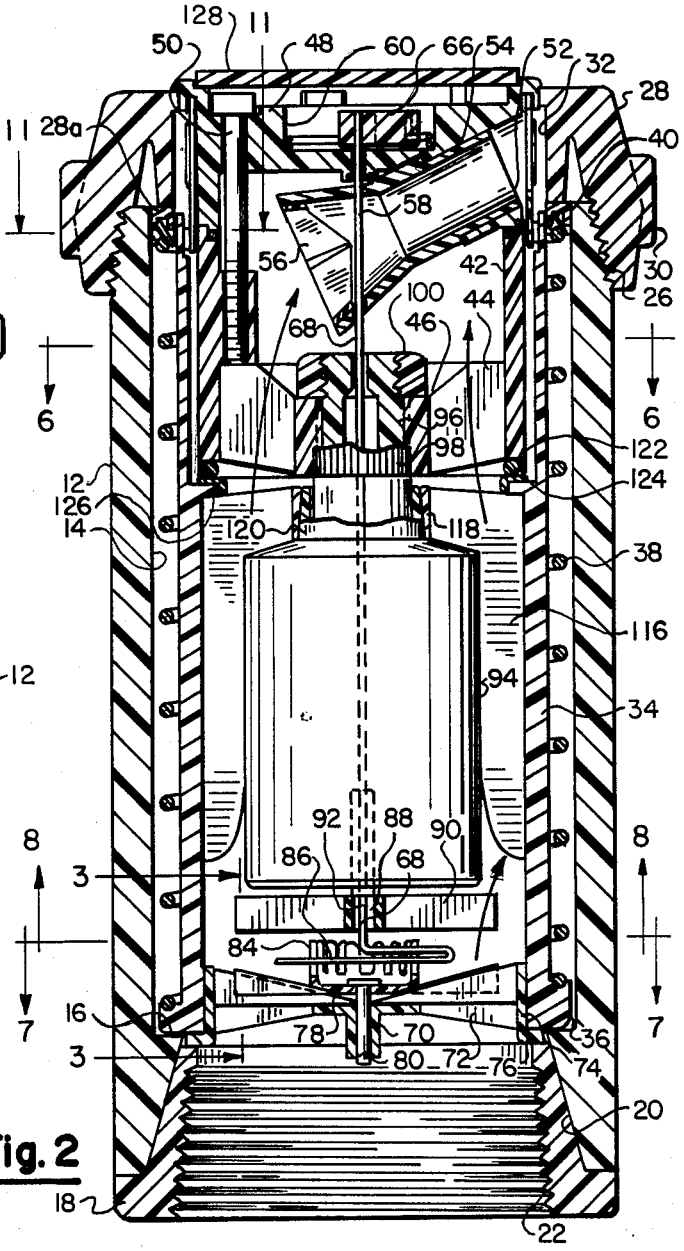
FIG. 2 is a second view taken generally on lines 2—2 of FIG. 1.

Referring particularly to FIGS. 1 and 2 of the drawings, there is illustrated a sprinkler unit of the pop up type designated generally by the numeral 10 which is constructed in accordance with the invention. The sprinkler unit 10 basically comprises a generally cylindrical tubular housing 12. The tubular housing 12 is generally elongated having a central through bore 14 with an annular inwardly extending shoulder 16 at the lower end thereof. The lower end is further provided with an adapter insert 18 which is fixed by threads, bonding, or otherwise into a tapered bore 20 at the lower end of the housing and includes a threaded bore 22 for attachment to a riser 24 for supply of pressurized water to the sprinkler unit.

The upper end of the housing is provided with annular threads 26 for the connection of a detachable or removable retaining cap or flange 28. The end cap or retainer flange 28 is provided with knobs er ridges 30 to provide good hand grip for removable and replacement of the retainer flange. The retainer flange 28 includes a bore 32 through which a pop up sleeve 34 extends for rising to the active position.

A cylindrical tubular sleeve 34 is telescopically mounted within the bore 14 of the tubular housing 12. The tubular sleeve is of a lesser diameter than the interior bore 14 of the housing leaving a space therein for accommodating an outwardly extending radial annular flange 36 on the lower end of the sleeve 34 which is engaged by a retracting spring such as a coil compression spring 38 disposed within the housing 12. The spring 38 is confined between the radial annular flange 36 and an annular shoulder 28a of the retaining cap 28. An annular seal assembly 40 is disposed between the upper end of spring 38 and the retaining shoulder 28a of the cap 28.

Mounted within the upper end of the sleeve 34 is a rotatable sprinkler head. The sprinkler head comprises a generally cylindrical tubular rim 42 connected by a plurality of radial spokes 44 to a central hub 46. This leaves open passages between the hub 46 and rim 42 for the free flow of water as indicated by the arrows.

An upper cap member 48 is detachably connected to the upper end of the member 42 coaxially therewith by means such as a plurality of elongated bolts or screws 50. The upper cap member 48 includes a cylindrical bore 52 extending outward at an angle to the central axis of the housing and unit for receiving a nozzle unit 54 therein. This permits nozzles of various orifice sizes to be inserted in the sprinkler head. The nozzle 54 has a generally funnel configuration with an inlet insert 56 of a generally spoked wheel configuration. A through bore 58 extends through the nozzle unit 54 for passage of a control rotor shaft 68 as will be subsequently explained.

Figure 5:
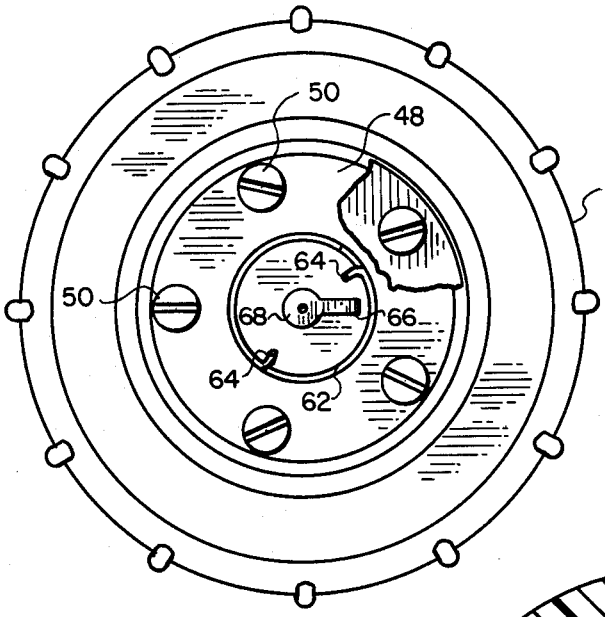
FIG. 5 is a top view of the unit of FIG. 1 with a portion of a cover broken away to show detail.
Figure 6:
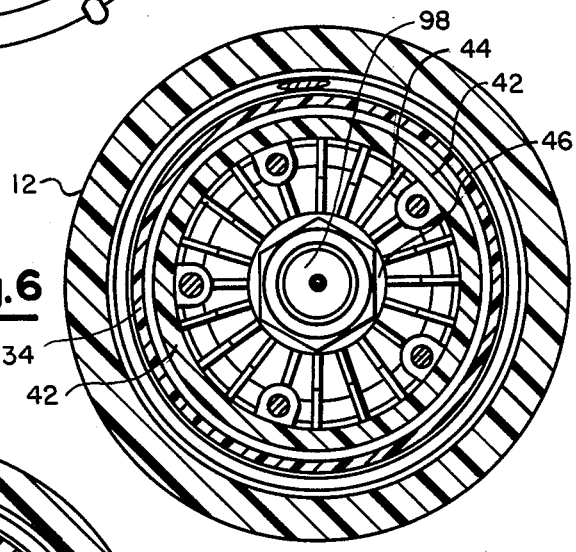
FIG. 6 is a section view taken generally on lines 6—6 of FIG. 2.
Figure 7:
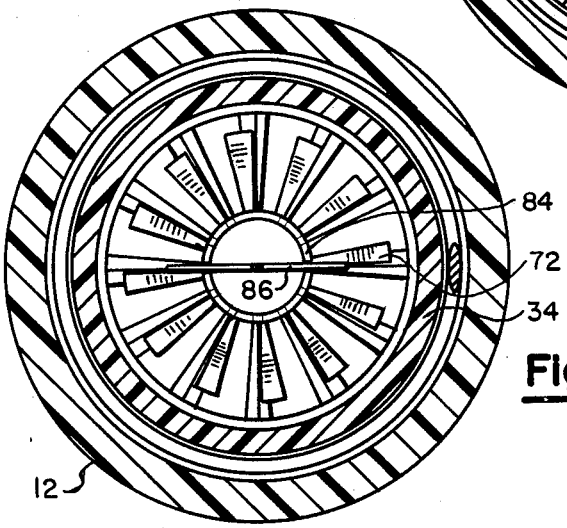
FIG. 7 is a section view taken generally on lines 7—7 of FIG. 2.
Figure 8:
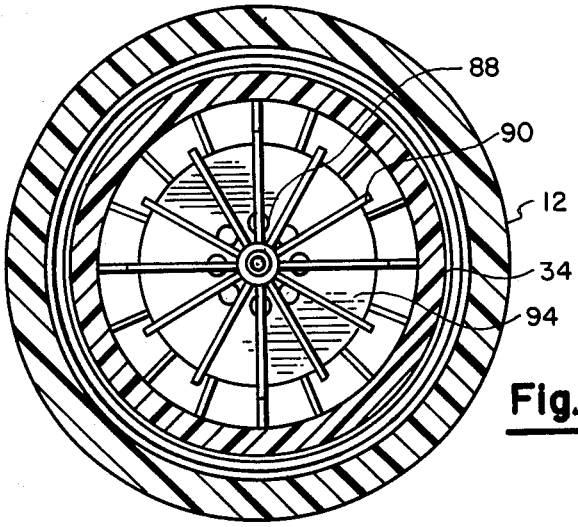
FIG. 8 is a section view taken generally on lines 8—8 of FIG. 2.

The sprinkler head cap 48 includes a generally cylindrical recess 60 located centrally and coaxially thereof in the top thereof. Disposed within this recess are shift fingers or members as can best be seen in FIG. 5 which include an inward positioned and upwardly directed finger 64 for engagement by a shift lever 66 which is mounted on the upper end of the stator reversing shaft 68. The shift members 62 are preferably formed of a spring wire in the form of a part circle having a greater diameter than bore 60 and frictionally engages the interior cylindrical walls of recess 60. One end of the shift member is straight and the other extends inwardly and upwardly to define the shift finger 64. The spring members can be adjustably positioned within the bore 60 and the shift fingers 64 positioned at any angular position therein for defining the limit position of the sprinkler head in its rotary motion.

The blades of the fixed stator form a generally V-shaped edge toward the direction of water flow forming sloped flow diverting surfaces at from about 30° to 60° to the axis of flow. The shifting or reversing stator, as will be explained, cooperate with the fixed blades to extend alternate ones of these sides for reversing of the turbine.

The shifting fingers 64 are carried by the rotating or oscillating sprinkler head and engage the shift arm 66 for rotating the shaft 68 and turbine stator reversing the turbine as will be explained. This reverses the direction of rotation of the sprinkler head and defines the limit of travel for each respective direction. It is obvious that the shift fingers 64 may be completely removed and the sprinkler head will rotate in a continuous circle in whichever direction is determined by the stator of the turbine.

The sprinkler head is driven by a water driven turbine that is located in the lower end of the sleeve 34 of the housing. The turbine comprises a fixed stator comprising a central hub 70 having radial spoke like blades 72 rhombus cross-sectional configuration extending radially outward to a peripheral rim 74 having a radial flange 76. The flange 76 extends over the lower end of the sleeve 34 and is press fitted therein.

Figure 3:
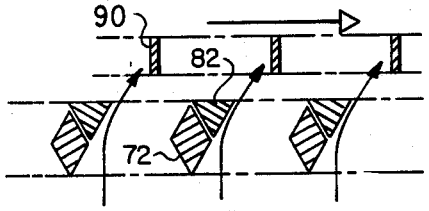
FIG. 3 is a section view taken generally on lines 3—3 showing one position of the reversing stator.
Figure 4:
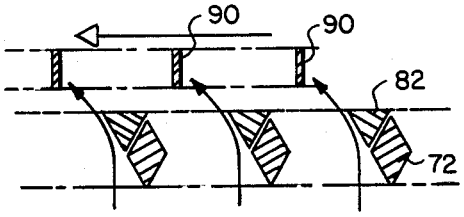
FIG. 4 is a view like FIG. 3 showing the reversing stators in a reversed position.

A shiftable stator comprises a central hub 78 rotatably mounted on a shaft 80 supported in the hub 70 of the fixed stator. The shiftable stator further comprises radially directed blades 82 which have a generally triangular cross-sectional configuration as shown in FIGS. 3 and 4 which engage the upper half of the diamond configured radial stator blade 72 of the fixed stator. This engagement of the shifting stator blades with the fixed blades forms an extended sloped diverting surface by the combination of surfaces as shown in FIGS. 3 and 4 that directs the stream of water in that direction. The hub 78 of the shiftable stator includes upwardly directed plurality of fingers 84 which extends generally axially of the housing and provides coupling means for the lower end of the shifting shaft 68. The shifting shaft has a generally T configuration at the lower end forming a crossbar 86 which extend or engage between the fingers 84 for coupling the stator to the shaft 68 which in turn is connected to the shifting arm 66 at the upper end of the shaft.

A rotary turbine blade comprises a central hub 88 and a plurality of radially directed turbine blades 90 connected thereto and extending radially outward therefrom. The turbine blade is mounted on a hollow drive shaft 92 which constitutes an input shaft for a reduction drive unit 94 mounted centrally within the housing or sleeve 34. The reduction drive gear unit includes suitable reduction drive gearing housed within the unit 94 for drivingly transmitting input rotary motion from shaft 92 to an output shaft 96 on which is drivingly connected to the hub 46 of the sprinkler head. The hub 46 is retained in position and drivingly coupled by a spline connection 98 and held in place on shaft 96 by a nut or the like 100. The input shaft 92 and output shaft 96 of the gear drive unit 94, and any shaft aligned therewith in between, are preferably hollow to permit extension of the actuating shaft 68 therethrough. This centrally locates the turbine reversing or shifting shaft and permits its connection coaxially of the sprinkler head as illustrated.

The reversing of the turbine is illustrated diagrammatically in FIGS. 3 and 4 wherein as shown in FIG. 3 movement of the blade 82 of the shifting stator against the right side of the fixed blades 72 of the fixed stator forms a diverting surface sloped toward the right diverting the flow of water through the stator blades in a direction as shown by the arrows in FIG. 3. These force the flow of water against the blades 90 of the turbine forcing the blades to move toward the right as indicated by the arrow. The illustrated turbine blades of a generally flat configuration forming essentially a paddle wheel.

Shifting the shiftable stator blades to the right such that they engage on the left side of the fixed stator blades 72 as shown in FIG. 4 forms a sloped diverting wall diverting the flow of water as shown in FIG. 4. This forces the deflected water toward the left engaging the right side of the turbine blades 90 forcing the blades to move in the direction as shown by the arrow toward the left.

Figure 9:
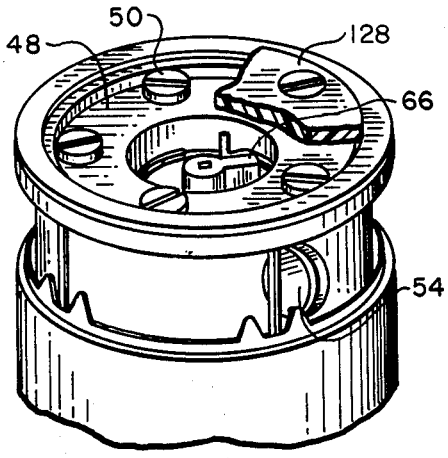
FIG. 9 is a perspective view of a portion of the sprinkler head showing the flow interrupter in position.
Figure 10:
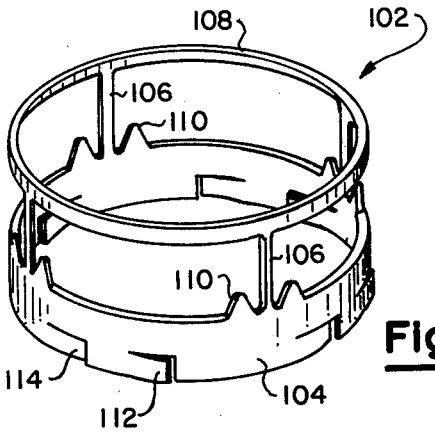
FIG. 10 is a perspective view of the flow interrupter.

Turning to FIGS. 9 and 10, the flow interrupter for the nozzle is illustrated. The flow interrupter comprises a thin flat circular band as shown in FIG. 10 designated generally by the numeral 102, of material such as a plastic or a metal having portions removed therefrom leaving a lower band or strip 104 with connecting ribs 106 to an upper band 108 defining a band having a plurality of generally rectangular windows. A plurality of tabs 110 are formed along the lower edge of the windows formed in the band. These ribs 106 and the tabs 110 pass in front of the opening of the nozzle 54 as can be seen in FIG. 9 periodically interrupting the flow of water as the sprinkler head rotates. This interruption in the water stream from the nozzle causes the stream to break up and spread the water within the inner areas of the circle covered by the sprinkler head.

Figure 11:
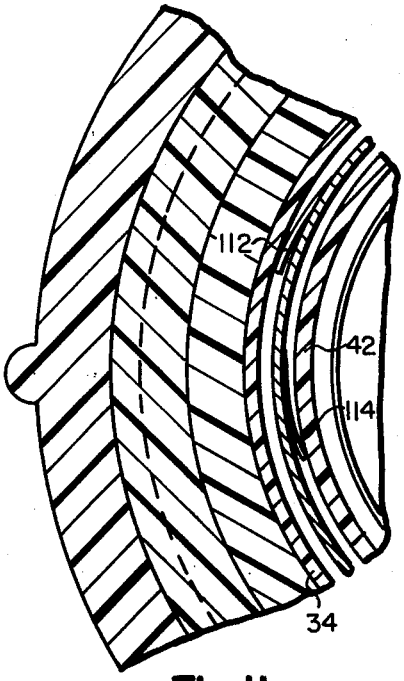
FIG. 11 is a detailed section view taken on lines 11—11 of FIG. 1 showing advancing drive for the flow interrupter.

Intermittent drive tabs 112 and 114 are formed around the lower edge of the flow interrupter as shown in FIG. 10. These extend between the outer walls of the rotating head or sleeve 42 and the interior surface of the wall of the fixed sleeve 34 such that as the member 42 rotates against the tabs 114 moving in a clockwise direction as shown in FIG. 11, it drives the flow interrupter band in the clockwise direction. As the sleeve 42 rotates in the opposite direction against tabs 112, it overrides the grip tab 114 with the grip tab 112 engaging the inner surface of the wall of the fixed sleeve 34 thus holding the interrupter in position. Thus, as the sprinkler head oscillates back and forth with sleeve 42 moving therewith, it intermittently picks up and steps the interrupter forward to various positions relative to the flow nozzle 54. The interrupter intermittently interrupts the flow of fluid from the nozzle 54 thus causing intermediate coverage of the water flow therefrom and a more uniform water coverage of the area covered by the sprinkler unit.

The gear drive unit 94 is housed within a generally cylindrical housing and is supported within the pop up housing 34 by a plurality of annularly spaced radially inwardly directed supporting ribs 116 and a centrally coaxially positioned ring 118. The gear drive unit housing is formed with a generally cylindrical tapered neck 120 which fits within a similarly shaped bore in the ring 118. The gear drive housing is preferably press fitted into the housing.

Water flows from the inlet at the bottom of the housing through the turbine drive unit and passes around the gear drive unit 94 between support ribs 116 and into the oscillating head. The flow of water passes along between ribs 44 and then passes through and out the nozzle. The oscillating head 42 is sealed at its lower end to the housing 34 by means of an O ring 122 seated in an annular recess and engaging generally flat circular seal member 124. The seal member 124 has a radial face that engages and rests on an annular inwardly directed rim or flange 126 on the interior of housing 34 and an axially extending rim extends through the bore formed by flange 126.

The coaxial positioning of the shifting shaft 68 has a number of advantages. These include the use of a simple straight rod for pure torsion action. This simplfies force transmissions and eliminates the necessity for fulcrum points. The simple straight rod is space saving and its coaxial location permits central top location of the trip fingers. The central location of the shift linkage also eliminates surface structures on the pop up housing which tends to interfere with the compactness and ease of operation thereof.

Locating the shaft 68 coaxially of the housing requires constructing the drive to be largely coaxial and be built around hollow coaxially positioned drive shafts. It also requires extension of the shaft through the nozzle insert. The shaft in this construction and arrangement acts as a pure torsion shaft, twisting about its axis like a torsion spring to accumulate torque.

In operation, as water is supplied from a pressurized source to a sprinkler unit that has been mounted on a suitable riser, water flowing into the unit applies pressure to cause the unit to pop up with the sleeve 34 and its contents moving upward against spring 38 extending upward and out of the upper end of the main housing 12. Water flowing through the unit first strikes the surfaces of the fixed and movable stator blades as shown in FIGS. 3 and 4 and is directed at an angle to the housing axis against the turbine blades forcing the turbine to rotate in a given direction.

The turbine drives an input shaft to a reduction drive gear unit 94 which has an output shaft coupled to the sprinkler head for rotating the head in a predetermined direction. As the head rotates in the predetermined direction, water continually flows through the unit out the nozzle 54 and passes outward in an arc over a surrounding surface area. As the head rotates, depending upon the direction of rotation, one of the shifting fingers 64 which is carried with the head as it rotates engages the shifting lever 66 which is mounted on the upper end and directly coupled to the shifting shaft 68. The shifting finger carries the arm 66 around storing torque in the shifting shaft 68 which is preferably spring wire until the accumulated torque is sufficient to snap the movable stator around to its alternate position thereby reversing the direction of impact of the water as shown in FIG. 4 thereby reversing the turbine. The upper end of the shaft 68 begins to rotate first with the lower end remaining fixed until sufficient torque is stored in the shaft to shift the stator. The turbine then drives the sprinkler head in the opposite direction.until the opposite finger engages the opposite side of the shifting arm 66 repeating the above described shifting and reversing action.

During the motion of the sprinkler head in one direction of motion, it picks up and carries with it the flow interrupting device 102 which intermittently positions either bar a 106 or one of the upwardly extending tabs 110 in front of or in the flow of water from the nozzle. This interrupts the stream to the extent that it causes a quantity of the water to fall short of its normal maximum range thereby distributing a quantity of the water somewhat evenly over the entire surface of the part circle surrounding the sprinkler head covered thereby. As the sprinkler head oscillates back and forth, it alternately overrides in one direction and engages in the other direction the pawls 114 as shown in FIGS. 10 and 11 thereby stepping the flow interrupter device 102 forward with each motion thereof in one direction. The arc covered by the sprinkler head is selected by the positioning of the shifting fingers 64.

While I have illustrated and described my invention by means of specific embodiments, it is to be understood that numerous changes and modifications may be made therein without departing from the spirit and scope of the invention as defined in the appended claims.

I claim:

1. A reversible sprinkler unit comprising:

a cylindrical tubular housing having an axis and inlet means for attachment to a source of pressurized water;

a sprinkler nozzle directed outward at an angle to and mounted for rotation about said axis of said housing and communicating with said inlet means;

a reversible turbine mounted in said housing for rotation about the axis of said housing and drivingly connected to said nozzle for rotating said nozzle in alternate directions about said axis, said turbine including reversible stator means;

flow interrupting means intermittently driven in one of said alternate directions by said sprinkler nozzle as said sprinkler nozzle rotates in said one direction and held stationary as said sprinkle nozzle rotates in the other of said alternate directions; and shifting means for shifting said stator to respective reversible positions including a torsion shaft member rotatably mounted and extending coaxial of said turbine and said housing.

2. The sprinkler unit of claim 1 wherein said flow interrupting means comprises a circular band having a plurality of windows therein and interrupting means extending into said windows for intermittently interrupting said flow.

3. The sprinkler unit of claim 2 wherein said flow interrupting means includes a ratchet and pawl combination drivingly engaging said sprinkler nozzle in one direction of rotation thereof and releaseably engaging said housing in the opposite direction of rotation of said sprinkler nozzle.

4. A reversible part circle sprinkler unit comprising:

a cylindrical tubular housing having a longitudinal axis and a central through bore with a central axis and means at one end for attachment to a source of pressurized water;

a sprinkler head rotatably mounted on the other end of said tubular housing coaxially thereof for rotation about said longitudinal axis thereof;

a reversible turbine mounted in said housing in the inlet end thereof and drivingly connected to said sprinkler head for driving said head in alternate directions; and said reversible turbine including reversible stator means comprising a fixed stator member coaxially mounted within said cylindrical housing and a rotatable stator member mounted on said fixed stator member for rotation about the longitudinal axis of said tubular housing; and shifting means for shifting said stator between alternate reversing positions, comprising an elongated torsion shaft member connected at one end to said stator means, mounting means along said axis for rotatably mounting said torsion shaft coaxially of said housing, and said torsion shaft terminating at the other end at a position coaxially, and exterior of said sprinkler head, and shifting lever means on said exterior end of said torsion shaft member, and reversing finger members carried by said sprinkler head for alternately engaging said shifting lever means for rotating said shaft thereby rotating said rotatable stator between alternate reversing positions.

5. The sprinkler unit of claim 4 wherein said torsion shaft has a generally T configuration at one end for connecting to said reversible stator means; and said reversing finger members comprising a pair of shift fingers.

6. The sprinkler unit of claim 5 wherein:

said head includes a cylindrical cavity coaxially thereof and coaxially of said tubular housing; and said torsion shaft extends into said cavity coaxially thereof and said shifting lever means are disposed within said cavity.

7. The sprinkler unit of claim 6 wherein said shift fingers are adjustably mounted within said cylindrical cavity.

8. The sprinkler unit of claim 7 wherein said shift fingers comprise a semi-circular spring wire member, having an inwardly and upwardly extending finger on one end thereof, for frictionally engaging the interior wall of said cylindrical cavity.

9. The sprinkler unit of claim 4 wherein:

said nozzle is directed outward at an angle to said axis; and flow interrupting means intermittently passing in front of said nozzle for disrupting the flow of water therefrom.

10. The sprinkler unit of claim 4 wherein said fixed stator member comprises a plurality of radially directed diamond shaped spokes radially directed outward from a central hub; and said rotatable stator member comprises a plurality of radially directed triangular cross-sectioned shaped spokes and is rotatably mounted coaxially with said fixed member with said radially directed spokes cooperatively engaging said diamond shaped spokes on alternate sides thereof for directing the flow of water in alternate directions for alternate directions of rotation of said turbine.

11. The sprinkler unit of claim 10 wherein said rotatable stator member comprises a plurality of axially directed fingers annularly spaced around the hub thereof; and said torsion member includes a T-shaped coupling member engaging said axially directed fingers.

12. The sprinkler unit of claim 4 wherein said fixed stator member comprises radially extending fingers of a generally diamond shaped cross-section;

said rotatable stator member comprises radial fingers of a generally triangular cross-section for cooperatively engaging said fixed fingers of said fixed stator member for defining alternately directed fluid directing stator surfaces.

13. The sprinkler unit of claim 12 comprising flow interrupting means intermittently driven by said sprinkler head in one direction of rotation of said head and held stationary in the other direction of rotation of said head for periodically interrupting the flow from said nozzle during rotation thereof;

said flow interrupting means comprising a circular band having windows therein and flow interrupting tab means in said windows.

14. The sprinkler unit of claim 12 comprising:

a cylindrical cavity formed coaxially in said sprinkler head;

said torsion shaft extends coaxially into said cavity and said shifting lever means is disposed within said cavity; and said reversing finger members are adjustably mounted in said cylindrical cavity for selectively adjusting the range of rotation of said sprinkler head.

15. The sprinkler unit of claim 14 wherein:

said reversing finger members are semi-circular spring wire members that frictionally engage the interior wall of said cylindrical cavity and each includes an inwardly and upwardly extending end defining a finger for engaging said shift lever.

16. The sprinkler unit of claim 15 wherein said torsion shaft member is a spring wire having a generally T-shaped end coupled to said rotatable stator member by engagement with axially extending fingers on said rotatable stator member.

17. The sprinkler unit of claim 13 comprising:

a cylindrical cavity formed coaxially in said sprinkler head;

said torsion shaft extends coaxially into said cavity and said shifting lever means is disposed within said cavity; and said reversing finger members are semi-circular spring wire members that frictionally engage the interior wall of said cylindrical cavity, and are thereby adjustably mounted in said cylindrical cavity for selectively adjusting the range of rotation of said sprinkler head, and each includes an inwardly and upwardly extending end defining a finger for engaging said shifting lever means.

* * * * *